US007491275B2

(12) United States Patent
Cao et al.

(10) Patent No.: US 7,491,275 B2
(45) Date of Patent: Feb. 17, 2009

(54) NICKEL-BASE ALLOYS AND METHODS OF HEAT TREATING NICKEL-BASE ALLOYS

(75) Inventors: Wei-Di Cao, Charlotte, NC (US); Richard L. Kennedy, Monroe, NC (US)

(73) Assignee: ATI Properties, Inc., Albany, OR (US)

( * ) Notice: Subject to any disclaimer, the term of this patent is extended or adjusted under 35 U.S.C. 154(b) by 105 days.

(21) Appl. No.: 11/544,808

(22) Filed: Oct. 6, 2006

(65) Prior Publication Data

US 2007/0029014 A1 Feb. 8, 2007

Related U.S. Application Data

(62) Division of application No. 10/679,899, filed on Oct. 6, 2003, now Pat. No. 7,156,932.

(51) Int. Cl.
*C22C 19/05* (2006.01)

(52) U.S. Cl. ..... 148/410; 420/448

(58) Field of Classification Search ..... 148/410, 148/428

See application file for complete search history.

(56) References Cited

U.S. PATENT DOCUMENTS 3,046,108 A 7/1962 Eiselstein
3,677,830 A 7/1972 Cox et al.
3,705,827 A * 12/1972 Muzyka et al. ..... 148/607
3,975,219 A 8/1976 Allen et al.
4,083,734 A 4/1978 Boesch
4,144,102 A 3/1979 Smith, Jr. et al.
4,219,592 A 8/1980 Anderson et al.
4,236,943 A 12/1980 Korenko et al.
4,371,404 A 2/1983 Duhl et al.
4,608,094 A 8/1986 Miller et al.
4,614,550 A 9/1986 Leonard et al.

(Continued)

FOREIGN PATENT DOCUMENTS

RU 2088684 C1 8/1997

(Continued)

OTHER PUBLICATIONS

Du, J.H., et al., Microstructure and Mechanical Properties of Novel 718 Superalloy, Acta Metallurgica Sinica (English Letters), vol. 19, No. 6, pp. 418-424, Dec. 2006.*

(Continued)

*Primary Examiner*—George Wyszomierski
(74) *Attorney, Agent, or Firm*—Kirkpatrick & Lockhart Preston Gates Ellis LLP; Patrick J. Viccaro; John E. Grosselin, III

(57) ABSTRACT

Embodiments of the present invention relate to nickel-base alloys, and in particular 718-type nickel-base alloys, having a desired microstructure that is predominantly strengthened by γ'-phase precipitates and comprises an amount of at least one grain boundary precipitate. Other embodiments of the present invention relate to methods of heat treating nickel-base alloys, and in particular 718-type nickel-base alloys, to develop a desired microstructure that can impart thermally stable mechanical properties. Articles of manufacture using the nickel-base alloys and methods of heat treating nickel-base alloys according to embodiments of the present invention are also disclosed.

7 Claims, 2 Drawing Sheets

U.S. PATENT DOCUMENTS

| | | | |
|---|---|---|---|
| 4,624,716 | A | 11/1986 | Noel et al. |
| 4,652,315 | A | 3/1987 | Igarashi et al. |
| 4,750,944 | A | 6/1988 | Snyder et al. |
| 4,777,017 | A | 10/1988 | Khan et al. |
| 4,788,036 | A | 11/1988 | Eiselstein et al. |
| 4,793,868 | A | 12/1988 | Chang |
| 4,798,632 | A | 1/1989 | Yonezawa et al. |
| 4,814,023 | A | 3/1989 | Chang |
| 4,837,384 | A | 6/1989 | Khan et al. |
| 4,888,253 | A | 12/1989 | Snyder et al. |
| 4,981,644 | A | 1/1991 | Chang |
| 5,006,163 | A | 4/1991 | Benn et al. |
| 5,047,091 | A | 9/1991 | Khan et al. |
| 5,077,004 | A | 12/1991 | Schweizer et al. |
| 5,087,305 | A | 2/1992 | Chang |
| 5,104,614 | A | 4/1992 | Ducrocq et al. |
| 5,129,970 | A | 7/1992 | Henry et al. |
| 5,131,961 | A | 7/1992 | Sato et al. |
| 5,154,884 | A | 10/1992 | Wukusick et al. |
| 5,156,808 | A | 10/1992 | Henry |
| 5,244,515 | A | 9/1993 | Miglin |
| 5,328,659 | A | 7/1994 | Tillman et al. |
| 5,403,546 | A | 4/1995 | Khan et al. |
| 5,424,029 | A | 6/1995 | Kennedy et al. |
| 5,431,750 | A | 7/1995 | Kawai et al. |
| 5,435,861 | A | 7/1995 | Khan et al. |
| 5,556,594 | A | 9/1996 | Frank et al. |
| 5,863,494 | A | 1/1999 | Nazmy et al. |
| 5,888,315 | A | 3/1999 | Ishii et al. |
| 5,888,316 | A | 3/1999 | Erickson |
| 5,916,382 | A | 6/1999 | Sato et al. |
| 6,106,767 | A | 8/2000 | Kennedy et al. |
| 6,193,823 | B1 | 2/2001 | Morra |
| 6,315,846 | B1 | 11/2001 | Hibner et al. |
| 6,328,827 | B1 | 12/2001 | Bouzidi et al. |
| 6,416,564 | B1 | 7/2002 | Bond et al. |
| 6,496,529 | B1 | 12/2002 | Jones et al. |
| 6,719,858 | B2 | 4/2004 | Bond et al. |
| 2001/0026769 | A1 | 10/2001 | Kobayashi et al. |
| 2002/0036037 | A1 | 3/2002 | Kennedy et al. |
| 2003/0034098 | A1 | 2/2003 | Henry et al. |
| 2003/0051777 | A1 | 3/2003 | Sudo |
| 2003/0116242 | A1 | 6/2003 | Harrison et al. |
| 2005/0072500 | A1 | 4/2005 | Cao et al. |
| 2007/0029017 | A1 | 2/2007 | Cao et al. |
| 2007/0044875 | A1 | 3/2007 | Kennedy et al. |

FOREIGN PATENT DOCUMENTS

| | | | |
|---|---|---|---|
| RU | 2112069 | C1 | 5/1998 |
| WO | WO 03/097888 | | 11/2003 |
| WO | WO 2005/038069 | A1 | 4/2005 |

OTHER PUBLICATIONS

Metals Handbook, tenth edition, vol. 1 Properties and Selection: Irons, Steels, and High-Performance Alloys, ASM International, 1990, p. 982.*

Key to Metals Nonferrous, "Heat treating of Nickel and Nickel Alloys", 3 pp., Key to Metals AG, 1999-2008.*

Mannan, S., et al., Physical Metallurgy of Alloys 718, 725, 725HS, 925 for Service in Aggressive Corrosive Environments, Special Metals Corporation, Huntington, WV, undated, 10 pp.*

Cao, U.S. Appl. No. 10/144,369, entitled "Nickel-Base Alloy," filed May 13, 2002 and assigned to ATI Properties, Inc.

Azadian, S. et al. "Precipitation in Spray-Formed IN718," *Proceedings of the 5th International Symposium on Superalloys 718, 625, 706 and Various Derivatives*, E. A. Loria ed., The Minerals, Metals & Materials Society, Warrendale, PA (2001), pp. 617-626.

Xie, Xishan et al. "The Role of Mg on Structure and Mechanical Properties in Alloy 718," *Superalloys 1988*, S. Reichman et al. eds., The Metallurgical Society (1998), pp. 635-642.

Andrieu, E. et al. "Influence of Compositional Modifications on Thermal Stability of Alloy 718," *Superalloys 718, 625, 706 and Various Derivatives*, E. A. Loria ed., The Minerals, Metals & Materials Society, Warrendale, PA (1994), pp. 695-710.

"Technical Data Sheet Allvac® 718 Alloy" Allvac, Monroe, NC (2000).

R. Warren, Liu-Ying Wei, Johan Ockborn "Interrelationships Between Thermomechancial Treatment, Microstructure and Properties of Nickel Base Superalloys" at http://www.ts.mah.se/forskn/mumat/Research/research_topic_rw.htm. (last updated Feb. 19, 2000).

Guo, Encai et al., "Further Studies on Thermal Stability of Modified 718 Alloys," *Superalloys 718, 625, 706 and Various Derivatives*, E. A. Loria ed., The Minerals, Metals & Material Society, Warrendale, PA (1994), pp. 721-734.

Gou, Encai et al., "Improving Thermal Stability of Alloy 718 Via Small Modifications in Composition," *Superalloy 718—Metallurgy and Applications*, E. A. Loria ed., The Minerals, Metals & Materials Society, Warrendale, PA (1989), pp. 567-576.

Andrieu, E. et al., "Effect of Environment and Microstructure on the High Temperature Behaviour of Alloy 718," *Superalloy 718—Metallurgy and Applications*, E. A. Loria ed., The Minerals, Metals & Materials Society, Warrendale, PA (1989), pp. 241-256.

R. Cozar et al., "Morphology of Y' and Y" Precipitates and Thermal Stability of Inconel 718 Type Alloys, *Metallurgical Transactions*, vol. 4, Jan. 1973, pp. 47-59.

Collier, John P. et al., "The Effect of Varying Al, Ti, and Nb Content on the Phase Stability of Inconel 718," *Metallurgical Transactions A*, vol. 19A, Jul. 1988, pp. 1657-1666.

Xie, Xishan et al., "The Role of Phosphorus and Sulfur in Inconel 718," *Superalloys 1996*, R.D. Kissinger et al. eds., The Minerals, Metals & Materials Society, Warrendale, PA (1996), pp. 599-606.

Collier, John P. et al. "On Developing a Microstructurally and Thermally Stable Iron-Nickel Superalloy," S. Reichman et al. eds., The Metallurgical Society (1988), pp. 43-53 (1988).

Manriquez, J.A. et al. "The High Temperature Stability of IN718 Derivative Alloys" *Superalloys* (1992) pp. 507-516.

Moyer et al. "Advances in Triple Melting Superalloys 718, 706 and 720," Proceedings of the International Symposium on Superalloys 718, 625, 706, and Various Derivatives Sponsored by the The Minerals, Metals & Materials Society, 1994, pp. 39-48.

Cordy et al., "Chemistry and Structure Control in Remelted Superalloy Ingots," Proceedings of the 1984 Vacuum Metallurgy Conference on Specialty Metals Melting and Processing, Pittsburgh, Pennsylvania, Jun. 11-13, 1984, pp. 69-74.

Choudhury, Alok, "State of the Art Superalloy Production for Aerospace and Other Application Using VIM/VAR or VIM/ESR," from ISIJ International, vol. 32, No. 5, 1992, pp. 563-574.

Burke et al., "Microstructure and Properties of Direct-Aged Alloy 625," Superalloys 718, 625, 706 and Various Derivatives, E.A. Loria Ed., The Minerals, Metals and Materials Society, 2001 pp. 389-398.

Radavich et al. "Effects of Processing and Thermal Treatments on Alloy 720," Proceedings of the Tenth International Conference on Vacuum Metallurgy, vol. I, Beijing, P.R. China, 1990, pp. 42-53.

Horvath et al., "The Effectiveness of Direct Aging on Inconel 718 Forgings Produced at High Strain Rates as Obtained on a Screw Press," Superalloys 718, 625, 706 and Various Derivatives, E.A. Loria Ed., The Mineral, Metals & Materials Society, 2001, pp. 223-228.

Krueger, "The Development of Direct Age 718 for Gas Turbine Engine Disk Applications," Superalloy 718 - Metallurgy and Applications, E.A. Loria Ed., The Minerals, Metals & Materials Society, 1989, pp. 279-296.

Barker et al., "Thermomechanical Processing of Inconel 718 and Its Effect on Properties," Advanced High Temperature Alloy: Processing and Properties, ASM, 1986, pp. 125-137.

ASM Handbook, vol. 14, fourth printing, (1996), electronic file, pp. 1-18.

Kennedy et al. "Developments in Wrought Nb Containing Superalloys (718 + 100 F)," Proceedings of the International Symposium on Niobium for High Temperature Application, Araxa, Brazil, Dec. 1-3, 2003, Published by TMS, indexed by Chemical Abstracts Service, Oct. 25, 2004, 12 pages.

Allvac® 718 Alloy Technical Data Sheet dated Dec. 31, 2001, 2 pages.
Allvac® 718 Plus™ Alloy Technical Data Sheet dated May 6, 2005, 3 pages
Allvac® 718 Plus® Alloy Technical Data Sheet dated Aug. 3, 2005, 3 pages.
Himushin, F.F., High Temperature Strength Metals and Alloys,: Moscow, 'Metallurgy' Publisher, 1969, pp. 443-449, 471.
Chen et al. "Strain-induced γ" phase precipitation and γ" → δ transformation in inconel 718 alloy," Metal Journal, Feb. 2000, vol. 36(2), pp. 150-154.
Kissinger, Trends and Near Term Requirements of GE Aircraft Engines Titanium and Nickel Base Disk Alloys. From the Conference: Electron Beam Melting and Refining - State of the Art 1991 in Reno, Nevada. Oct. 1992, pp. 31-40.
Cao et al., "The Effect of Phosphorous on Mechanical Properties of Alloy 718," Superalloys 718, 625, 706 and Various Derivatives, pp. 463-477 (1994).
Kennedy et al., "Stress-rupture Strength of Alloy 718," Advanced Materials & Processes, vol. 149, No. 3, Mar. 1996, pp. 33-35.
Cao et al., "Phosphorous - Boron Interaction in Nickel-Base Superalloys," Superalloys 1996, The Minerals, Matels & Materials Society, pp. 589-597 (1996).
Cao et al., "Production Evaluation on 718-ER® Alloy," Superalloys 2000, The Minerals, Metals & Materials Society, pp. 101-108 (2000).
Xie et al., "The Role of Phosphorous and Sulfur in Inconel 718," Superalloys 1996, The Minerals, Metals and Materials Society, pp. 599-606 (1996).
Chang et al., "Rene 220: 100° F. Improvement Over Alloy 718," Superalloy 718 - Metallurgy and Applications, The Minerals, Metals & Materials Society, pp. 631-645 (1989).
Schafrik et al., "Application of Alloy 718 in GE Aircraft Engines: Past, Present and the Next Five Years," Superalloys 718, 625, 706 and Various Derivatives, pp. 1-11 (2001).
Kennedy et al., "Large Diameter Superalloys Ingots," Advanced Technologies for Superalloy Affordability, ed. Chang et al., The Minerals, Metals & Materials Society, 2000, pp. 159-171.
Schwant et al. "Large 718 Forgings for Land Based Turbines," Superalloys 718, 625, 706 and Various Derivatives, ed. E.A. Loria, The Minerals, Metals & Materials Society, Warrendale, PA, 1997, pp. 141-152.
Cao et al., "Effect and Mechanism of Phosphorous and Boron on Creep Deformation of Alloy 718," Superalloys 718, 625, 706 and Various Derivatives, ed. E.A. Loria, 1997, pp. 511-520.
Xie et al., "Segregation Behavior of Phosphorous and Its Effect on Microstructure and Mechanical Properties in Alloy System Ni-Cr-Fe-Mo-Nb-Ti-Al," Superalloys 718, 625, 706 and Various Derivatives, ed. E.A. Loria, 1997, pp. 531-542.
Bond et al., "Evaluation of Allvac® 718PLUS™ Alloy in the Cold Worked and Heat Treated Condition," Superalloys 718, 625, 706 and Derivatives 2005, ed. E.A. Loria, The Minerals, Metals & Materials Society, 2005, pp. 203-211.
Kennedy, R.L., "Allvac® 718PLUS™, Superalloy for the Next Forty Years," Superalloys 718, 625, 706 and Derivatives 2005, ed. E.A. Loria, The Minerals, Metals & Materials Society, 2005, pages 1-14.
Warren et al., "The Cyclic Fatigue Behavior of Direct Age 718 and 149, 315, 454 and 538° C.," Materials Science & Engineering, A vol. 428, 2006, pp. 106-115.

* cited by examiner

NICKEL-BASE ALLOYS AND METHODS OF HEAT TREATING NICKEL-BASE ALLOYS

CROSS-REFERENCE TO RELATED APPLICATIONS

This is a divisional of co-pending application Ser. No. 10/679,899, filed Oct. 6, 2003.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

Embodiments of the present invention generally relate to nickel-base alloys and methods of heat treating nickel-base alloys. More specifically, certain embodiments of the present invention relate to nickel-base alloys having a desired microstructure and having thermally stable mechanical properties (such as one or more of tensile strength, yield strength, elongation, stress-rupture life, and low notch sensitivity). Other embodiments of the present invention relate to methods of heat treating nickel-base alloys to develop a desired microstructure that can impart thermally stable mechanical properties at elevated temperatures, especially tensile strength, stress-rupture life, and low notch-sensitivity, to the alloys.

2. Description of Related Art

Alloy 718 is one of the most widely used nickel-base alloys, and is described generally in U.S. Pat. No. 3,046,108, the specification of which is specifically incorporated by reference herein.

The extensive use of Alloy 718 stems from several unique features of the alloy. For example, Alloy 718 has high strength and stress-rupture properties up to about 1200° F. Additionally, Alloy 718 has good processing characteristics, such as castability and hot-workability, as well as good weldability. These characteristics permit components made from Alloy 718 to be easily fabricated and, when necessary, repaired. As discussed below, Alloy 718's unique features stem from a precipitation-hardened microstructure that is predominantly strengthened by γ"-phase precipitates.

In precipitation-hardened, nickel-base alloys, there are two principal strengthening phases: γ'-phase (or "gamma prime") precipitates and γ"-phase (or "gamma double prime") precipitates. Both the γ'-phase and the γ"-phase are stoichiometric, nickel-rich intermetallic compounds. However, the γ'-phase typically comprises aluminum and titanium as the major alloying elements, i.e., $Ni_3(Al, Ti)$; while the γ"-phase contains primarily niobium, i.e., $Ni_3Nb$. While both the γ'-phase and the γ"-phase form coherent precipitates in the face centered cubic austenite matrix, because there is a larger misfit strain energy associated with the γ"-phase precipitates (which have a body centered tetragonal crystal structure) than with the γ'-phase precipitates (which have a face centered cubic crystal structure), γ"-phase precipitates tend to be more efficient strengtheners than γ'-phase precipitates. That is, for the same precipitate volume fraction and particle size, nickel-base alloys strengthened by γ"-phase precipitates are generally stronger than nickel alloys that are strengthened primarily by γ'-phase precipitates.

However, one disadvantage to such a γ"-phase precipitate strengthened microstructure is that at temperatures higher than 1200° F., the γ"-phase is unstable and will transform into the more stable δ-phase (or "delta-phase"). While δ-phase precipitates have the same composition as γ"-phase precipitates (i.e., $Ni_3Nb$), δ-phase precipitates have an orthorhombic crystal structure and are incoherent with the austenite matrix. Accordingly, the strengthening effect of δ-phase precipitates on the matrix is generally considered to be negligible. Therefore, as a result of this transformation, the mechanical properties of Alloy 718, such as stress-rupture life, deteriorate rapidly at temperatures above 1200° F. Therefore, the use of Alloy 718 typically is limited to applications below this temperature.

In order to form the desired precipitation-hardened microstructure, the nickel-base alloys must be subjected to a heat treatment or precipitation hardening process. The precipitation hardening process for a nickel-base alloy generally involves solution treating the alloy by heating the alloy at a temperature sufficient to dissolve substantially all of the γ'-phase and γ"-phase precipitates that exist in the alloy (i.e., a temperature near, at or above the solvus temperature of the precipitates), cooling the alloy from the solution treating temperature, and subsequently aging the alloy in one or more aging steps. Aging is conducted at temperatures below the solvus temperature of the gamma precipitates in order to permit the desired precipitates to develop in a controlled manner.

The development of the desired microstructure in the nickel-base alloy depends upon both the alloy composition and precipitation hardening process (i.e., the solution treating and aging processes) employed. For example, a typical precipitation hardening procedure for Alloy 718 for high temperature service involves solution treating the alloy at a temperature of 1750° F. for 1 to 2 hours, air cooling the alloy, followed by aging the alloy in a two-step aging process. The first aging step involves heating the alloy at a first aging temperature of 1325° F. for 8 hours, cooling the alloy at about 50 to 100° F. per hour to a second aging temperature of 1150° F., and aging the alloy at the second aging temperature for 8 hours. Thereafter, the alloy is air cooled to room temperature. The precipitation-hardened microstructure that results after the above-described heat treatment is comprised of discrete γ' and γ"-phase precipitates, but is predominantly strengthened by the γ"-phase precipitates with minor amounts of the γ'-phase precipitates playing a secondary strengthening role.

Due to the foregoing limitations, many attempts have been made to improve upon Alloy 718. For example, modified Alloy 718 compositions that have controlled aluminum, titanium, and niobium alloying additions have been developed in order to improve the high temperature stability of the mechanical properties of the alloy. In particular, these alloys were developed in order to promote the development of a "compact morphology" microstructure during the precipitation hardening process. The compact morphology microstructure consists of large, cubic γ'-phase precipitates with γ"-phase precipitates being formed on the faces of the cubic γ'-phase precipitates. In other words, the γ"-phase forms a shell around the γ'-phase precipitates.

In addition to modified chemistry, a specialized heat treatment or precipitation hardening process is necessary to achieve the compact morphology microstructure, instead of the discrete γ'-phase and γ"-phase precipitate hardened microstructure previously discussed. One example of a specialized heat treatment that is useful in developing the compact morphology microstructure involves solution treating the alloy at a temperature around 1800° F., air cooling the alloy, and subsequently aging the alloy at a first aging temperature of approximately 1562° F. for about a half an hour, in order to precipitate coarse γ'-phase precipitates. After aging at the first aging temperature, the alloy is rapidly cooled to a second aging temperature by air cooling, and held at the second aging temperature, which is around 1200° F., for about 16 hours in order to form the γ"-phase shell. Thereafter, the alloy is air cooled to room temperature. As previously discussed, after this precipitation hardening process, the alloy will have the compact morphology microstructure described above and will have improved high temperature stability. However, the tensile strength of alloys having the compact morphology microstructure is generally significantly lower than for standard Alloy 718.

Many γ'-phase strengthened nickel-base alloys exist, for example, Waspaloy® nickel alloy, which is commercially available from Allvac of Monroe, N.C. However, because Waspaloy® nickel alloy contains increased levels of alloying additions as compared to Alloy 718, such as nickel, cobalt, and molybdenum, this alloy tends to be more expensive than Alloy 718. Further, because of the relatively fast precipitation kinetics of the γ'-phase precipitates as compared to the γ"-phase precipitates, the hot workability and weldability of this alloy is generally considered to be inferior to Alloy 718.

Accordingly, it would be desirable to develop an affordable, precipitation-hardened 718-type nickel-base alloy having a microstructure that is predominantly strengthened by the more thermally stable γ'-phase precipitates, that possesses thermally stable mechanical properties at temperatures greater than 1200° F., and that has comparable hot-workability and weldability to γ"-phase strengthened alloys. Further, it is desirable to develop methods of heat treating nickel-base alloys to develop a microstructure that is predominanty strengthened by thermally stable γ'-phase precipitates and that can provide nickel-base alloys with thermally stable mechanical properties and comparable hot-workability and weldability to γ"-phase strengthened alloys.

BRIEF SUMMARY OF THE INVENTION

Certain embodiments of the present invention are directed toward methods of heat treating nickel-base alloys. For example, according to one non-limiting embodiment there is provided a method of heat treating a nickel-base alloy comprising pre-solution treating the nickel-base alloy wherein an amount of at least one grain boundary precipitate selected from the group consisting of δ-phase precipitates and η-phase precipitates is formed within the nickel-base alloy, the at least one grain boundary precipitate having a short, generally rod-shaped morphology; solution treating the nickel-base alloy wherein substantially all γ'-phase precipitates and γ"-phase precipitates in the nickel-base alloy are dissolved while at least a portion of the amount of the at least one grain boundary precipitate is retained; cooling the nickel-base alloy after solution treating the nickel-base alloy at a first cooling rate sufficient to suppress formation of γ'-phase and γ"-phase precipitates in the nickel-base alloy; aging the nickel-base alloy in a first aging treatment wherein primary precipitates of γ'-phase and γ"-phase are formed in the nickel-base alloy; and aging the nickel-base alloy in a second aging treatment wherein secondary precipitates of γ'-phase and γ"-phase are formed in the nickel-base alloy, the secondary precipitates being finer than the primary precipitates; and wherein after heat treating the γ'-phase precipitates are predominant strengthening precipitates in the nickel-base alloy.

Accordingly, it would be desirable to develop an affordable, precipitation-hardened 718-type nickel-base alloy having a microstructure that is predominantly strengthened by the more thermally stable γ'-phase precipitates, that possesses thermally stable mechanical properties at temperatures greater than 1200° F., and that has comparable hot-workability and weldability to γ"-phase strengthened alloys. Further, it is desirable to develop methods of heat treating nickel-base alloys to develop a microstructure that is predominantly strengthened by thermally stable γ'-phase precipitates and that can provide nickel-base alloys with thermally stable mechanical properties and comparable hot-workability and weldability to γ"-phase strengthened alloys.

Still another non-limiting embodiment provides a method of heat treating a nickel-base alloy, the nickel-base alloy comprising, in weight percent, up to 0.1 carbon, from 12 to 20 chromium, up to 4 molybdenum, up to 6 tungsten, from 5 to 12 cobalt, up to 14 iron, from 4 to 8 niobium, from 0.6 to 2.6 aluminum, from 0.4 to 1.4 titanium, from 0.003 to 0.03 phosphorus, from 0.003 to 0.015 boron, and nickel; wherein a sum of the weight percent of molybdenum and the weight percent of tungsten is at least 2 and not more than 8, and wherein a sum of atomic percent aluminum and atomic percent titanium is from 2 to 6, a ratio of atomic percent aluminum to atomic percent titanium is at least 1.5, and the sum of atomic percent aluminum and atomic percent titanium divided by atomic percent niobium is from 0.8 to 1.3. The method comprises solution treating the nickel-base alloy for no greater than 4 hours at a solution temperature ranging from 1725° F. to 1850° F.; cooling the nickel-base alloy at a first cooling rate after solution treating the nickel-base alloy; aging the solution treated nickel-base alloy in a first aging treatment for no greater than 8 hours at a temperature ranging from 1365° F. to 1450° F.; and aging the nickel-base alloy in a second aging treatment for at least 8 hours at a second aging temperature, the second aging temperature ranging from 1150° F. to 1300° F.

Other embodiments of the present invention contemplate nickel-base alloys having a desired microstructure. For example, in one non-limiting embodiment there is provided a nickel-base alloy comprising a matrix comprising γ'-phase precipitates and γ"-phase precipitates, wherein the γ'-phase precipitates are predominant strengthening precipitates in the nickel-base alloy, and an amount of a at least one grain boundary precipitate selected from the group consisting of δ-phase precipitates and η-phase precipitates, wherein the at least one grain boundary precipitate has a short, generally rod-shaped morphology; and wherein the nickel-base alloy has a yield strength at 1300° F. of at least 120 ksi, a percent elongation at 1300° F. of at least 12 percent, a notched stress-rupture life of at least 300 hours as measured at 1300° F. and 80 ksi, and a low notch-sensitivity.

Another non-limiting embodiment provides a 718-type nickel-base alloy including up to 14 weight percent iron and comprising γ'-phase precipitates and γ"-phase precipitates, wherein the γ'-phase precipitates are the predominant strengthening precipitates in the nickel-base alloy, and an amount of at least one grain boundary precipitate selected from the group consisting of δ-phase precipitates and η-phase precipitates, wherein the at least one grain boundary precipitate has a short, generally rod-shaped morphology; wherein the nickel-base alloy is heat treated by pre-solution treating the nickel-base alloy at a temperature ranging from 1500° F. to 1650° F. for a time ranging from 2 to 16 hours; solution treating the nickel-base alloy by heating the nickel-base alloy for no greater than 4 hours at a solution temperature ranging from 1725° F. to 1850° F.; cooling the nickel-base alloy at a first cooling rate of at least 800° F. per hour after solution treating the nickel-base alloy; aging the nickel-base alloy in a first aging treatment from 2 hours to 8 hours at a temperature ranging from 1325° F. to 1450° F.; and aging the nickel-base alloy in a second aging treatment for at least 8 hours at a second aging temperature, the second aging temperature ranging from 1150° F. to 1300° F.

Articles of manufacture and methods of forming article of manufacture are also contemplated by various embodiments of the present invention. For example, there is provided in one non-limiting embodiment of the present invention, an article of manufacture comprising a nickel-base alloy, the nickel-base alloy comprising a matrix comprising γ'-phase precipitates and γ"-phase precipitates, wherein the γ'-phase precipitates are predominant strengthening precipitates in the nickel-base alloy, and an amount of at least one grain boundary precipitate selected from the group consisting of δ-phase precipitates and η-phase precipitates, wherein the at least one grain boundary precipitates has a short, generally rod-shaped morphology; and wherein the nickel-base alloy has a yield strength at 1300° F. of at least 120 ksi, a percent elongation at 1300° F. of at least 12 percent, a notched stress-rupture life of at least 300 hours as measured at 1300° F. and 80 ksi, and a low notch-sensitivity.

Another non-limiting embodiment provides a method of forming an article of manufacture comprising a 718-type nickel-base alloy including up to 14 weight percent iron, the method comprising forming the nickel-base alloy into a desired configuration, and heat treating the nickel-base alloy, wherein heat treating the nickel-base alloy comprises pre-solution treating the nickel-base alloy at a temperature ranging from 1500° F. to 1650° F. for a time ranging from 2 to 16 hours, solution treating the nickel-base alloy for no greater than 4 hours at a solution temperature ranging from 1725° F. to 1850° F., cooling the nickel-base alloy at a first cooling rate of at least 800° F. per hour after solution treating the nickel-base alloy, aging the nickel-base alloy in a first aging treatment from 2 hours to 8 hours at a temperature ranging from 1325° F. to 1450° F., and aging the nickel-base alloy in a second aging treatment for at least 8 hours at a second aging temperature, the second aging temperature ranging from 1150° F. to 1300° F.

BRIEF DESCRIPTION OF THE SEVERAL VIEWS OF THE DRAWING(S)

Embodiments of the present invention will be better understood if read in conjunction with the figures, in which.

DETAILED DESCRIPTION OF THE INVENTION

Figure 1:
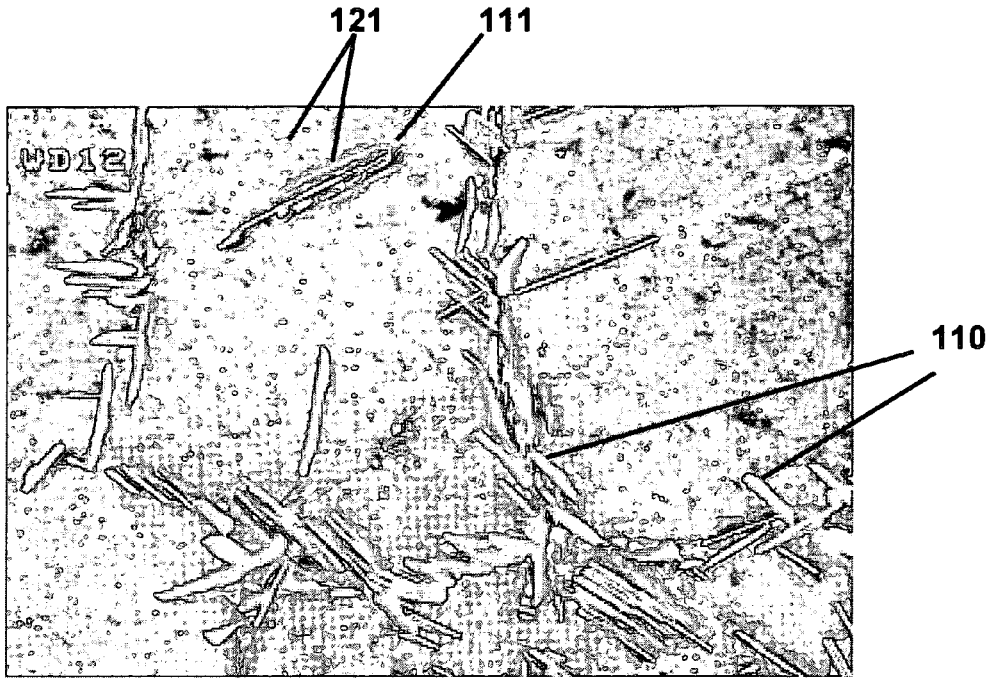
FIG. 1 is an SEM micrograph of a nickel-base alloy according to embodiments of the present invention.

Certain non-limiting embodiments of the present invention can be advantageous in providing nickel-base alloys having a desired microstructure and thermally stable mechanical properties at elevated temperatures. As used herein, the phrase "thermally stable mechanical properties" means that the mechanical properties of the alloy (such as tensile strength, yield strength, elongation, and stress-rupture life) are not substantially decreased after exposure at 1400° F. for 100 hours as compared to the same mechanical properties before exposure. As used herein the term "low notch-sensitivity" means that samples of the alloy, when tested according to ASTM E292, do not fail at the notch. Further, the non-limiting embodiments of the present invention may be advantageous in providing predominantly γ'-phase strengthened nickel-base alloys comprising at least one grain boundary phase precipitate and having comparable hot-workability and weldability to γ"-phase strengthened alloys.

Methods of heat treating nickel-base alloys according to various non-limiting embodiments of the present invention will now be described. Although not limiting herein, the methods of heat treating nickel-base alloys discussed herein can be used in conjunction with a variety of nickel-base alloy compositions, and are particularly suited for use with 718-type nickel-base alloys and derivatives thereof. As used herein the term "nickel-base alloy(s)" means alloys of nickel and one or more alloying elements. As used herein the term "718-type nickel-base alloy(s)" means nickel-base alloys comprising chromium and iron that are strengthened by one or more of niobium, aluminum, and titanium alloying additions.

One specific, non-limiting example of a 718-type nickel-base alloy for which the heat treating methods of the various non-limiting embodiments of the present invention are particularly well suited is a 718-type nickel-base alloy including up to 14 weight percent iron. Although not meant to be limiting herein, 718-type nickel-base alloys including up to 14 weight percent iron are believed to be advantageous in producing alloys having good stress-rupture life. While not intending to be bound by any particular theory, it is believed by the inventors that when the iron content of the alloy is high, for example 18 weight percent, the effectiveness of cobalt in lowering stacking fault energy may be reduced. Since low stacking fault energies are associated with improved stress-rupture life, in certain embodiments of the present invention, the iron content of the nickel-base alloy is desirably maintained at or below 14 weight percent.

Another specific, non-limiting example of a 718-type nickel-base alloy for which the heat treating methods according to the various non-limiting embodiments of the present invention are particularly well suited is a nickel-base alloy comprising, in percent by weight, up to 0.1 carbon, from 12 to 20 chromium, up to 4 molybdenum, up to 6 tungsten, from 5 to 12 cobalt, up to 14 iron, from 4 to 8 niobium, from 0.6 to 2.6 aluminum, from 0.4 to 1.4 titanium, from 0.003 to 0.03 phosphorus, from 0.003 to 0.015 boron, and nickel; wherein a sum of the weight percent of molybdenum and the weight percent of tungsten is at least 2 and not more than 8, and wherein a sum of atomic percent aluminum and atomic percent titanium is from 2 to 6, a ratio of atomic percent aluminum to atomic percent titanium is at least 1.5, and the sum of atomic percent aluminum and atomic percent titanium divided by atomic percent niobium is from 0.8 to 1.3. Such alloys are described in detail in co-pending U.S. application Ser. No. 10/144,369, the specification of which is specifically incorporated by reference herein.

A method of heat treating a nickel-base alloy according to a first, non-limiting embodiment of the present invention comprises pre-solution treating the nickel-base alloy, solution treating the nickel-base alloy, and aging the nickel-base alloy to form a nickel-base alloy having a microstructure wherein γ'-phase precipitates are the predominant strengthening precipitates and δ-phase and/or η-phase precipitates having a desired morphology are present in one or more of the grain boundaries of the alloy.

More specifically, the method of heat treating a nickel-base alloy according to the first non-limiting embodiment comprises pre-solution treating the nickel-base alloy wherein an amount of at least one grain boundary precipitate is formed within the nickel-base alloy. As used herein the term "pre-solution treating" means heating the nickel-base alloy, prior to solution treating the nickel-base alloy, at a temperature such that an amount of at least one grain boundary precipitate is formed within the nickel-base alloy. As used herein, the term "form" with respect to any phase means nucleation and/or growth of the phase. For example, although not limiting herein, pre-solution treating the nickel-base alloy can comprise heating the nickel-base alloy in a furnace at a temperature ranging from about 1500° F. to about 1650° F. for about 2 hours to about 16 hours. In one specific, non-limiting example of a pre-solution treatment that can be particularly useful in processing wrought nickel-base alloys, the pre-solution treatment can comprise heating the alloy at a temperature ranging from about 1550° F. to 1600° F. for about 4 to 16 hours.

As discussed above, during the pre-solution treatment, an amount of at least one grain boundary precipitate is formed in the nickel-base alloy. According to the first non-limiting embodiment, the at least one grain boundary precipitate formed during the pre-solution treatment is selected from the group consisting of δ-phase ("delta-phase") precipitates and η-phase ("eta-phase") precipitates. Delta-phase precipitates are known in the art to consist of the ordered intermetallic phase $Ni_3Nb$ and have an orthorhombic crystal structure. Eta-phase precipitates are known in the art to consist of the ordered intermetallic phase $Ni_3Ti$ and have a hexagonal crystal structure. Further, according to this embodiment, during pre-solution treatment both δ-phase and η-phase grain boundary precipitates can be formed.

While generally the formation of δ-phase and/or η-phase precipitates (hereinafter "δ/η-phase" precipitates) in nickel-base alloys due to the overaging of γ"-phase precipitates is undesirable because these precipitates are incoherent and do not contribute to the strengthening of the austenite matrix, the inventors have observed that the precipitation of a controlled amount of δ/η-phase precipitates having a desired morphology and location in grain boundaries of the nickel-base alloy (as discussed in more detail below) can strengthen the grain boundaries and contribute to reduced notch-sensitivity, and improved stress-rupture life and ductility in the alloy at elevated temperatures. Further, as discussed below in more detail, when the controlled amount of at least one grain boundary precipitate is combined with γ'-phase and γ"-phase precipitates having the desired size distribution, nickel-base alloys having low notch-sensitivity, good tensile strength, stress-rupture life, and thermally stable mechanical properties to at least 1300° F. can be achieved.

Figure 2:
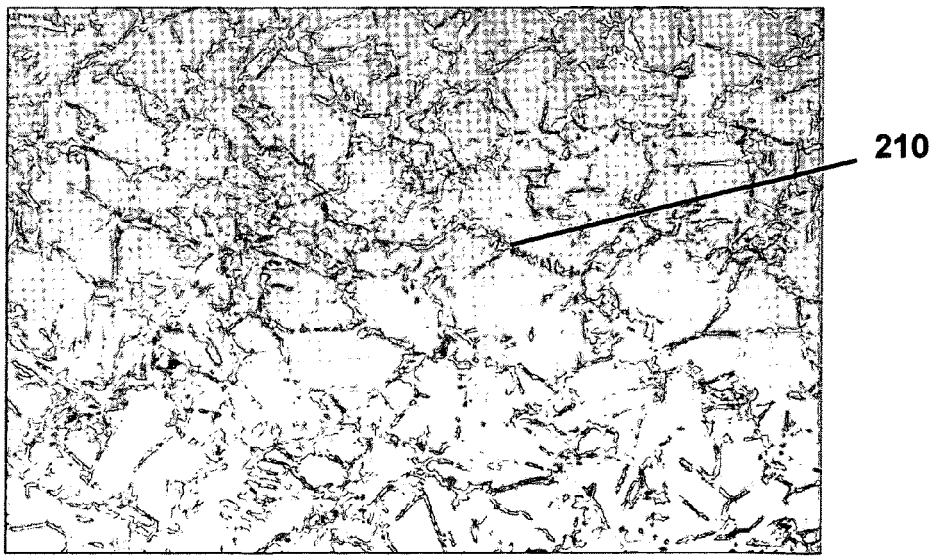
FIG. 2 is an optical micrograph of a nickel-base alloy according to embodiments of the present invention.

Referring now to the figures, in FIG. 1, there is shown an SEM micrograph of a nickel-base alloy according to embodiments of the present invention taken at 3000× magnification. In FIG. 2 there is shown an optical micrograph of the same nickel-base alloy taken at 500× magnification. The nickel-base alloy shown in FIGS. 1 and 2 comprises an amount of at least one grain boundary precipitate having the desired morphology and location according to certain non-limiting embodiments of the present invention. As shown in FIG. 1, the nickel-base alloy comprises δ/η-phase precipitates 110, the majority of which have a short, generally rod-shaped morphology and are located within the grain boundaries of the alloy. As used herein the phrase "short, generally rod-shaped" with reference to the precipitates means the precipitates having a length to thickness aspect ratio no greater than about 20, for example as shown in FIGS. 1 and 2. In certain non-limiting embodiments of the present invention, the aspect ratio of the short, generally rod-shaped precipitates ranges from 1 to 20. While δ/η-phase precipitates at twin boundaries in the nickel-base alloy can occasionally be present (for example, as shown in FIG. 1, δ/η-phase precipitates 111 can be observed at twin boundary 121), no significant formation of intragranular, needle-shaped δ/η-phase precipitates should be present in the nickel-base alloys processed in accordance with the various non-limiting embodiments of the present invention.

Although not meaning to be bound by any particular theory, it is believed by the inventors that both the morphology of the precipitates and location of precipitates at the grain boundaries, shown in FIGS. 1 and 2, are desirable in providing a nickel-base alloy having low notch-sensitivity and improved tensile ductility and stress-rupture life because these grain boundary precipitates can restrict grain boundary sliding in the alloy at elevated temperatures. In other words, because of their morphology and location, the grain boundary precipitates according to embodiments of the present invention effectively strengthen the grain boundaries by resisting movement of the grain boundaries by "locking" or "pinning" the grain boundaries in place. Since grain boundary sliding contributes substantially to creep deformation and the formation of inter-granular cracks, which can decrease stress-rupture life and increase notch-sensitivity of the alloy, by restricting grain boundary sliding in the nickel-base alloys according to embodiments of the present invention, the grain boundary precipitates can increase the tensile ductility and stress-rupture life of the alloy and decrease the notch-sensitivity of the alloy. In contrast, when no grain boundary phase is present, or when excessive precipitation occurs (as shown in FIGS. 3 and 4, which are discussed below), the grain boundaries will not be strengthened and the stress-rupture life of the alloy will not be improved.

In certain non-limiting embodiments of the present invention, after heat treating the nickel-base alloy a majority of grain boundaries of the nickel-base alloy are pinned by at least one short, generally rod-shaped grain boundary precipitate, such as precipitate 210 shown in FIG. 2. In other embodiments of the present invention, at least two-thirds (⅔) of the grain boundaries are pinned by at least one short, generally rod-shaped grain boundary phase precipitate. Thus, according to these non-limiting embodiments, although pinning of all of the grain boundaries by at least one grain boundary precipitate is contemplated, it is not necessary that all of the grain boundaries be pinned.

Figure 3:
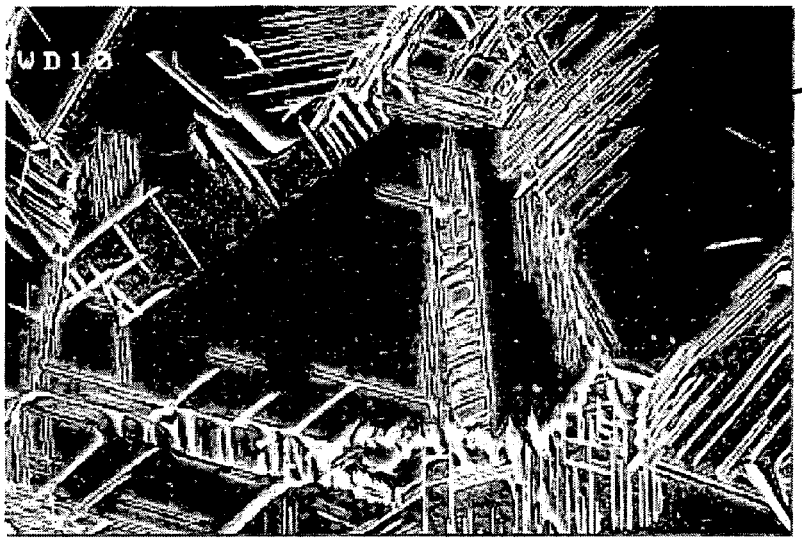
FIG. 3 is an SEM micrograph of a nickel-base alloy having excessive grain boundary phase development.
Figure 4:
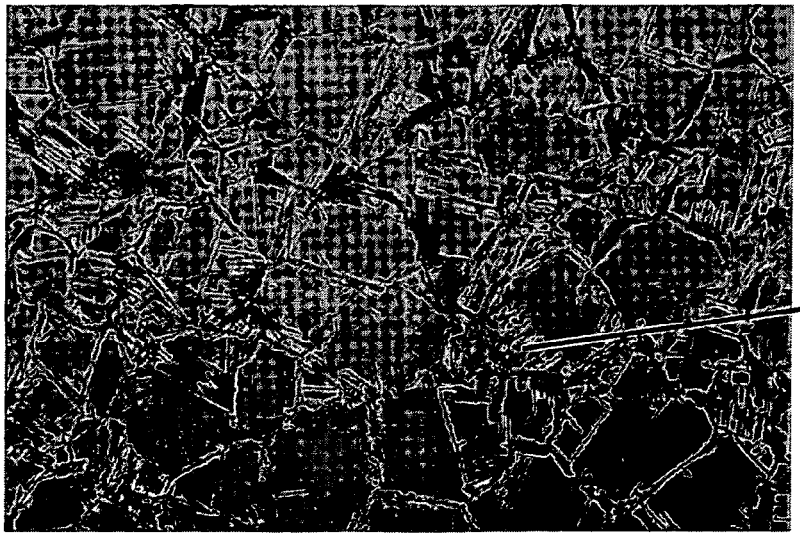
FIG. 4 is an optical micrograph of a nickel-base alloy having excessive grain boundary phase development.

In contrast, FIGS. 3 and 4 are micrographs of a nickel-base alloy having excessive formation of δ/η-phase precipitates. As shown in FIG. 3, the majority of the precipitates 310 have a sharp, needle-like morphology with a much larger aspect ratio than those shown in FIGS. 1 and 2, and extend a significant distance into the grains, and in some cases, extend across an individual grain. Although not meant to be bound by any particular theory, it is believed by the inventors that the δ/η-phase precipitate morphology and the location of the precipitates in the grains shown in FIGS. 3 and 4 is undesirable because the δ/η-phase precipitates (310 and 410, shown in FIGS. 3 and 4 respectively) do not strengthen the grain boundaries as discussed above. Instead, the interface between the precipitate and the grain matrix becomes the easiest path for crack propagation. Further, the excessive formation of δ/η-phase precipitates reduces the amount of strengthening precipitates (i.e., γ' and γ") in the alloy, thereby reducing the strength of the alloy (as previously discussed). Accordingly, although the precipitates such as those shown in FIGS. 3 and 4 can contribute to an increase in elevated temperature ductility, such precipitation will significantly reduce alloy tensile strength and stress-rupture life.

While not intending to be bound by any particular theory, the inventors have also observed that the morphology of δ/η-phase grain boundary precipitates is related to precipitation temperature and the grain size of the alloy. Thus, for example, although not limiting herein, for certain wrought alloys when the precipitation temperature is greater than about 1600° F., and for certain cast alloys when the precipitation temperature is greater than about 1650° F., generally the δ/η-phase precipitates will form both on grain boundaries and intragranularly as high aspect ratio needles. As discussed above, this typically decreases the tensile strength and stress-rupture life of the alloy. However, when precipitation of the δ/η-phase occurs in these alloys at temperatures below about 1600° F. and 1650° F., respectively, δ/η-phase precipitates having a relatively short, generally rod-shaped morphology form at the grain boundaries, with little intragranular precipitation. As previously discussed, the formation of these grain boundary precipitates in the nickel-base alloy is desirable because these grain boundary precipitates can lock or pin the grain boundaries, thereby improving the tensile strength and ductility, and stress-rupture life, while decreasing notch-sensitivity of the alloy.

After pre-solution treating, according to the first non-limiting embodiment of the present invention, the nickel-base alloy can be cooled to 1000° F. or less prior to solution treating. For example, although not limiting herein, the alloy can be cooled to room temperature prior to solution treating. As used herein, the term "solution treating" means heating the nickel-base alloy at a solution temperature near (i.e., a temperature no less than about 100° F. below), at or above the solvus temperature of the γ' and γ"-phase precipitates, but below the solvus temperature for the grain boundary precipitates. Thus, as discussed above, during solution treatment of the nickel-base alloy, substantially all the γ'- and γ"-phase precipitates that exist in the nickel-base alloy are dissolved. As used herein, the term "substantially all" with respect to the dissolution of the γ' and γ"-phase precipitates during solution treating means at least a majority of the γ' and γ"-phase precipitates are dissolved. Accordingly, dissolving substantially all of the γ'- and γ"-phase precipitates during solution treating includes, but is not limited to, dissolving all of the γ'- and γ"-phase precipitates. However, since the solution temperature is below the solvus temperature for the grain boundary precipitates (i.e., the δ/η-phase precipitates formed during pre-solution treatment), at least a portion of the amount of the at least one grain boundary precipitate is retained in the nickel-base alloy during solution treatment.

Although not limiting herein, according to this non-limiting embodiment, solution treating the nickel-base alloy can comprise heating the nickel-base alloy at a solution temperature no greater than 1850° F. for no more than 4 hours. More particularly, solution treating the nickel-base alloy can comprise heating the nickel-base alloy at a solution temperature ranging from 1725° F. to 1850° F., and more preferably comprises heating the nickel-base alloy from 1750° F. to 1800° F. for a time ranging from 1 to 4 hours, and more preferably from 1 to 2 hours. However, it will be appreciated by those skilled in the art that the exact solution treatment time required to dissolve substantially all of the γ'- and γ"-phase precipitates will depend on several factors, including but not limited to, the size of the nickel-base alloy being solution treated. Thus, the bigger the nickel-base alloy (or work piece comprising the nickel-base alloy) being treated, generally the longer the solution time required to achieve the desired result will be.

Although not meaning to be bound by any particular theory, it has been observed by the inventors that if the solution temperature is above about 1850° F., a less than desired amount of grain boundary precipitates may be retained in the nickel-base alloy after solution treating. Accordingly, the notch-sensitivity, elevated temperature stress-rupture life and ductility of the alloy can be detrimentally affected. However, for applications in which these properties are not critical, solution temperatures greater than 1850° F. can be utilized in accordance with this non-limiting embodiment of the present invention. Further, it has been observed by the inventors that if the solution temperature is below about 1725° F., substantially all of the γ'-phase and γ"-phase precipitates will not dissolve during solution treatment. Accordingly, undesirable growth and coarsening of the undissolved γ'-phase and γ"-phase precipitates can occur, leading to lower tensile strength and stress-rupture life.

After solution treating the nickel-base alloy, the nickel-base alloy is cooled at a first cooling rate sufficient to suppress formation of γ'-phase and γ"-phase precipitates in the nickel-base alloy during cooling. Although not meant to be limiting herein, the inventors have observed that if the nickel-base alloy is cooled too slowly after solution treatment, in addition to the undesired precipitation and coarsening of γ'-phase and γ"-phase precipitates, the formation of excessive grain boundary precipitates can occur. As discussed above, the formation of excessive grain boundary precipitates can detrimentally impact the tensile strength and stress-rupture life of the alloy. Thus, according to the first non-limiting embodiment of the present invention, the first cooling rate is at least 800° F. per hour, and can be at least 1000° F. per hour or greater. Cooling rates in excess of 800° F. or 1000F can be achieved, for example by air cooling the alloys from the solution temperature.

After solution treating and cooling the nickel-base alloy according to the first non-limiting embodiment of the present invention, the nickel-base alloy is aged in a first aging treatment. As used herein the term "aging"means heating the nickel-base alloy at a temperature below the solvus temperatures for the γ'-phase and the Γ"-phase to form γ'-phase and γ"-phase precipitates. During the first aging treatment, primary precipitates of γ'-phase and γ"-phase are formed in the nickel-base alloy. Although not limiting herein, according to this non-limiting embodiment, the first aging treatment can comprise heating the nickel-base alloy at temperatures ranging from 1325° F. to 1450° F. for a time period ranging from 2 to 8 hours. More particularly, the first aging treatment can comprise heating the nickel-base alloy at a temperature ranging from 1365° F. to 1450° F. for 2 to 8 hours. Although not meant to be limiting herein, aging at a first aging temperature greater than about 1450° F. or less than about 1325° F. can result in overaging or underaging of the alloy, respectively, with an accompanying loss of strength.

After the first aging treatment, the nickel-base alloy is cooled to a second aging temperature and aged in a second aging treatment. Although not required, according to this embodiment of the present invention the second cooling rate can be 50° F. per hour or greater. For example, a cooling rate ranging from about 50° F. per hour to about 100° F. per hour can be achieved by allowing the nickel-base alloy to cool in the furnace while the furnace cools to a desired temperature or after the power to the furnace is turned off (i.e., furnace cooling the alloy). Alternatively, although not limiting herein, the nickel-base alloy can be more rapidly cooled, for example by air cooling to room temperature, and then subsequently heated to the second aging temperature. However, if a more rapid cooling rate is employed, longer aging times may be required in order to develop the desired microstructure.

The nickel-base alloy is aged at the second aging temperature to form secondary precipitates of γ'-phase and γ"-phase in the nickel-base alloy. The secondary precipitates of γ'-phase and γ"-phase formed during the second aging treatment are generally finer than the primary precipitates formed during the first aging treatment. That is, the size of the precipitates formed during the second aging treatment will generally be smaller than the size of the primary precipitates formed during the first aging treatment. Although not meaning to be bound by any particular theory, the formation of γ'-phase precipitates and γ"-phase precipitates having a distribution of sizes, as opposed to a uniform precipitate size, is believed to improve the mechanical properties of the nickel-base alloy.

Further, according to the first non-limiting embodiment, the second aging treatment can comprise heating the nickel-base alloy at a second aging temperature ranging from 1150° F. to 1300° F., and more specifically can comprise heating the nickel-base alloy at a second aging temperature ranging from 1150° F. to 1200° F. for at least 8 hours.

As previously discussed, after heat treating the nickel-base alloy according to the first non-limiting embodiment of the present invention, the γ'-phase precipitates are predominant strengthening precipitates in the nickel-base alloy. As used herein, the phrase "predominant strengthening precipitates" with respect to the γ'-phase precipitates means the nickel-base alloy comprises at least about 20 volume percent γ'-phase and no more than about 5 volume percent γ"-phase. Further, after heat treating, the nickel-base alloy according to this non-limiting embodiment comprises an amount of at least one grain boundary precipitate selected from the group consisting of δ-phase precipitates and η-phase precipitates and having a short, generally rod-shaped morphology.

In a second non-limiting embodiment of the present invention, the nickel-base alloy is heated to a pre-solution temperature ranging from about 1500° F. to 1600° F. for a period of time in order to precipitate a controlled amount of at least one grain boundary precipitate selected from the group consisting of δ-phase precipitates and η-phase precipitates. As discussed above with respect to the first non-limiting embodiment, desirably, the at least one precipitate has a short, generally rod-shaped morphology and is located at the grain boundaries of the alloy.

After solution treating and cooling the nickel-base alloy according to the first non-limiting embodiment of the present invention, the nickel-base alloy is aged in a first aging treatment. As used herein the term "aging" heating the nickel-base alloy at a temperature below the solvus temperatures for the γ'-phase and the γ"-phase to form γ'-phase and γ'-phase precipitates. During the first aging treatment, primary precipitates of γ'-phase and γ"-phase are formed in the nickel-base alloy. Although not limiting herein, according to this non-limiting embodiment, the first aging treatment can comprise heating the nickel-base alloy at temperatures ranging from 1325° F. to 1450° F. for a time period ranging from 2 to 8 hours. More particularly, the first aging treatment can comprise heating the nickel-base alloy at a temperature ranging from 1365° F. to 1450° F. for 2 to 8 hours. Although not meant to be limiting herein, aging at a first aging temperature greater than about 1450° F. or less than about 1325° F. can result in overaging or underaging of the alloy, respectively, with an accompanying loss of strength.

A third non-limiting embodiment of the present invention provides a method of heat treating a 718-type nickel-base alloy including up to 14 weight percent iron, the method comprising pre-solution treating the nickel-base alloy at a temperature ranging from 1500° F. to 1650° F. for a time ranging from 2 to 16 hours. After pre-solution treatment, the nickel-base alloy is solution treated for no greater than 4 hours at a solution temperature ranging from 1725° F. to 1850° F., and preferably for no greater than 2 hours at a solution temperature ranging from 1750° F. to 1800° F. Thereafter, the nickel-base alloy can be cooled to room temperature and aged as discussed above with respect to the first non-limiting embodiment of the present invention. After heat treating the nickel-base alloy according to this non-limiting embodiment of the present invention, the nickel-base alloy desirably has a microstructure comprising γ'-phase precipitates and γ"-phase precipitates, wherein the γ'-phase precipitates are predominant strengthening precipitates in the nickel-base alloy, and an amount of at least one grain boundary precipitate selected from the group consisting of δ-phase precipitates and η-phase precipitates, the at least one grain boundary precipitate having a short, generally rod-shaped morphology.

A fourth non-limiting embodiment according to the present invention provides a method of heat treating a nickel-base alloy, the nickel-base alloy comprising, in weight percent, up to 0.1 carbon, from 12 to 20 chromium, up to 4 molybdenum, up to 6 tungsten, from 5 to 12 cobalt, up to 14 iron, from 4 to 8 niobium, from 0.6 to 2.6 aluminum, from 0.4 to 1.4 titanium, from 0.003 to 0.03 phosphorus, from 0.003 to 0.015 boron, and nickel; wherein a sum of the weight percent of molybdenum and the weight percent of tungsten is at least 2 and not more than 8, and wherein a sum of atomic percent aluminum and atomic percent titanium is from 2 to 6, a ratio of atomic percent aluminum to atomic percent titanium is at least 1.5, and the sum of atomic percent aluminum and atomic percent titanium divided by atomic percent niobium is from 0.8 to 1.3. The method comprises solution treating the nickel-base alloy by heating the nickel-base alloy for no greater than 4 hours at a solution temperature ranging from 1725° F. to 1850° F., and more particularly comprises solution treating the nickel-base alloy by heating the nickel-base alloy for not greater than 2 hours at a solution temperature ranging from 1750° F. to 1800° F. The method further comprises cooling the nickel-base alloy after solution treating at a first cooling rate, and aging the nickel-base alloy as discussed above with respect to the first non-limiting embodiment of the present invention. After heat treating the nickel-base alloy according to the fourth non-limiting embodiment of the present invention, the nickel-base alloy desirably has a microstructure that is predominantly strengthened by γ'-phase precipitates and may comprise an amount of at least one grain boundary precipitate selected from the group consisting of δ-phase precipitates and η-phase precipitates, the at least one grain boundary precipitate having a short, generally rod-shaped morphology.

Although not required, the method according to the fourth non-limiting embodiment of the present invention can further comprise pre-solution treating the nickel-base alloy at a temperature ranging from 1500° F. to 1650° F. for a time period ranging from 2 to 16 hours prior to solution treating the nickel-base alloy. As previously discussed, by pre-solution treating the nickel-base alloy, a controlled amount of at least one grain boundary precipitate can be formed in the alloy. Accordingly, after heat treating the nickel-base alloy, the nickel-base alloy desirably has a microstructure that is primarily strengthened by γ'-phase precipitates and comprises an amount of at least one grain boundary precipitate selected from the group consisting of δ-phase precipitates and η-phase precipitates, wherein the at least one grain boundary precipitate has a short, generally rod-shaped morphology.

Although not limiting herein, after heat treating the nickel-base alloy according to the various non-limiting embodiments of the present invention discussed above, the nickel-base alloy can have a yield strength at 1300° F. of at least 120 ksi, a percent elongation at 1300° F. of at least 12 percent, a notched stress-rupture life of at least 300 hours as measured at 1300° F. and 80 ksi, and a low notch-sensitivity. Although not required, after heat treating the alloy can have a grain size of ASTM 5-8.

Nickel-base alloys having a desired microstructure according to certain non-limiting embodiments of the present invention will now be discussed. In one non-limiting embodiment of the present invention, there is provided a nickel-base alloy comprising a matrix comprising γ'-phase precipitates and γ"-phase precipitates, wherein the γ'-phase precipitates are predominant strengthening precipitates in the nickel-base alloy, and a controlled amount of at least one grain boundary precipitate, the at least one grain boundary precipitate being selected from the group consisting of δ-phase precipitates and η-phase precipitates; and wherein the nickel-base alloy has a yield strength at 1300° F. of at least 120 ksi, a percent elongation at 1300° F. of at least 12 percent, a notched stress-rupture life of at least 300 hours as measured at 1300° F. and 80 ksi, and a low notch-sensitivity.

According to this non-limiting embodiment, the nickel-base alloy can be a 718-type nickel-base alloy. For example, the 718-type nickel-base alloy can be a 718-type nickel-base alloy comprising up to 14 weight percent iron. Further, the 718-type nickel-base alloy can be a nickel-base alloy comprising, in weight percent, up to 0.1 carbon, from 12 to 20 chromium, up to 4 molybdenum, up to 6 tungsten, from 5 to 12 cobalt, up to 14 iron, from 4 to 8 niobium, from 0.6 to 2.6 aluminum, from 0.4 to 1.4 titanium, from 0.003 to 0.03 phosphorus, from 0.003 to 0.015 boron, and nickel; wherein a sum of the weight percent of molybdenum and the weight percent of tungsten is at least 2 and not more than 8, and wherein a sum of atomic percent aluminum and atomic percent titanium is from 2 to 6, a ratio of atomic percent aluminum to atomic percent titanium is at least 1.5, and the sum of atomic percent aluminum and atomic percent titanium divided by atomic percent niobium is from 0.8 to 1.3.

The nickel-base alloy according to this non-limiting embodiment can be a cast or wrought nickel-base alloy. For example, although not limiting herein, the nickel-base alloy can be manufactured by melting raw materials having the desired composition in a vacuum induction melting ("VIM") operation, and subsequently casting the molten material into an ingot. Thereafter, the cast material can be further refined by remelting the ingot. For example, the cast material can be remelted via vacuum arc remelting ("VAR"), electro-slag remelting ("ESR"), or a combination of ESR and VAR, all of which are known in the art. Alternatively, other methods known in the art for melting and remelting can be utilized.

After melting, the nickel-base alloy can be heat treated to form the desired microstructure. For example, although not limiting herein, the nickel-base alloy can be heat treated according to the methods of heat treating discussed in the various non-limiting embodiments of the present invention discussed above to form the desired microstructure. Alternatively, the alloy can be first forged or hot or cold worked prior to heat treating.

One specific, non-limiting embodiment of a nickel-base alloy according to the present invention provides a 718-type nickel-base alloy including up to 14 weight percent iron and comprising γ'-phase precipitates and γ"-phase precipitates, wherein the γ'-phase precipitates are predominant strengthening precipitates in the nickel-base alloy, and an amount of at least one grain boundary precipitate selected from the group consisting of δ-phase precipitates and η-phase precipitates, the at least one grain boundary precipitate having a short, generally rod-shaped morphology. According to this non-limiting embodiment, the nickel-base alloy can be formed, for example, by pre-solution treating the nickel-base alloy by heating the nickel-base alloy at a temperature ranging from 1500° F. to 1650° F. for a time ranging from 4 to 16 hours, solution treating the nickel-base alloy by heating the nickel-base alloy for no greater than 4 hours at a solution temperature ranging from 1725° F. to 1850° F., cooling the nickel-base alloy at a first cooling rate of at least 800° F. per hour after solution treating the nickel-base alloy, aging the nickel-base alloy in a first aging treatment by heating the nickel-base alloy for 2 to 8 hours at a temperature ranging from 1325° F. to 1450° F., and aging the nickel-base alloy in a second aging treatment by heating the nickel-base alloy for at least 8 hours at the second aging temperature, the second aging temperature ranging from 1150° F. to 1300° F.

Embodiments of the present invention further contemplate articles of manufacture made using the nickel-base alloys and methods of heat treating nickel-base alloys of the present invention. Non-limiting examples of articles of manufacture that can be made using the nickel-base alloys and methods of heat treating nickel-base alloys according to the various embodiments of the present invention include, but are not limited to, turbine or compressor disks, blades, cases, shafts, and fasteners.

For example, although not limiting herein, one embodiment of the present invention provides an article of manufacture comprising a nickel-base alloy, the nickel-base alloy comprising a matrix comprising γ'-phase precipitates and γ"-phase precipitates, wherein the γ'-phase precipitates are predominant strengthening precipitates in the nickel-base alloy, and an amount of at least one grain boundary precipitate selected from the group consisting of δ-phase precipitates and η-phase precipitates; and wherein the nickel-base alloy has a yield strength at 1300° F. of at least 120 ksi, a percent elongation at 1300° F. of at least 12 percent, a notched stress-rupture life of at least 300 hours as measured at 1300° F. and 80 ksi, and a low notch-sensitivity. Although not required, the nickel-base alloy can have a grain size of ASTM 5-8.

Although not limiting herein, the articles of manufacture according to this non-limiting embodiment of the present invention can be formed, for example, by forming a cast or wrought nickel-base alloy having the desired composition into the desired configuration, and then subsequently heat treating the nickel-base alloy to form the desired microstructure discussed above. More particularly, although not limiting herein, according to certain embodiments of the present invention the articles of manufacture can be formed from cast or wrought 718-type nickel-base alloys, and more particularly 718-type nickel-base alloys that include up to 14 weight percent iron. In one specific non-limiting embodiment of the present invention, the article of manufacture is formed from a nickel-base alloy comprising, in percent by weight, up to 0.1 carbon, from 12 to 20 chromium, up to 4 molybdenum, up to 6 tungsten, from 5 to 12 cobalt, up to 14 iron, from 4 to 8 niobium, from 0.6 to 2.6 aluminum, from 0.4 to 1.4 titanium, from 0.003 to 0.03 phosphorus, from 0.003 to 0.015 boron, and nickel; wherein a sum of the weight percent of molybdenum and the weight percent of tungsten is at least 2 and not more than 8, and wherein a sum of atomic percent aluminum and atomic percent titanium is from 2 to 6, a ratio of atomic percent aluminum to atomic percent titanium is at least 1.5, and the sum of atomic percent aluminum and atomic percent titanium divided by atomic percent niobium is from 0.8 to 1.3.

Various non-limiting embodiments of the present invention will now be illustrated in the following non-limiting examples.

EXAMPLES

Example 1

A 718-type nickel-base alloy was melted prepared using in a VIM operation and subsequently cast into an ingot. Thereafter, the cast material was remelted using VAR. The cast material was then forged into an 8" diameter, round billet and test samples were cut the billet. The alloy had a grain size ranging from ASTM 6 to ASTM 8, with an average grain size of ASTM 7, as determined according to ASTM E 112, as determined according to ASTM E 112. The composition of alloy is given below.

| Element | Weight Percent |
|---|---|
| C | 0.028 |
| W | 1.04 |
| Co | 9.17 |
| Nb | 5.50 |
| Al | 1.47 |
| B | 0.005 |
| Mo | 2.72 |
| Cr | 17.46 |
| Fe | 9.70 |
| Ti | 0.71 |
| P | 0.014 |
| Ni + residual elements | Balance |

The test samples were then divided into sample groups and the sample groups were subjected the pre-solution treatment indicated below in Table 1.

TABLE 1

| Sample Group | Pre-solution Treatment |
|---|---|
| 1 | None |
| 2 | 1550° F. for 8 Hours |
| 3 | 1600° F. for 8 Hours |
| 4 | 1650° F. for 8 Hours |

After pre-solution treatment, each of the sample groups were solution treated at 1750° F. for 1 hour, air cooled, aged for 2 hours at 1450° F., furnace cooled, aged for 8 hours at 1200° F., and air cooled to room temperature. After heat treating the following tests were performed. At least 2 samples from each sample group were subjected to tensile testing at 1300° F. according to ASTM E21 and the tensile strength, yield strength, percent elongation, and percent reduction in area for each sample were determined. At least 2 samples from each sample group were subjected to stress-rupture life testing at 1300° F. and 80 ksi according to ASTM 292 and the stress-rupture life and percent elongation at rupture for each sample were determined. At least 2 samples from each group were subjected to Charpy testing at room temperature according to ASTM E262 and the impact strength and lateral expansion ("LE") of each sample were determined.

The results of the aforementioned tests are indicated below in Table 2, wherein the tabled value is the average value of the samples tested from each sample group.

TABLE 2

| Sample Group | Tensile Strength at 1300° F. (ksi) | Yield Strength at 1300° F. (ksi) | Percent Elongation at 1300° F. | Percent Reduction in Area at 1300° F. | Stress-Rupture Life at 1300° F. (Hours) | Percent Elongation at Rupture at 1300° F. | Impact Strength at Room Temp. (Ft. lbs) | LE at Room Temp (mils) |
|---|---|---|---|---|---|---|---|---|
| 1 | 170.3 | 145.7 | 19.3 | 18.1 | 433.1 | 35.4 | 13.5 | 8.5 |
| 2 | 172.3 | 149.2 | 28.9 | 52.3 | 581.4 | 29.4 | 33.5 | 19.0 |
| 3 | 169.3 | 143.9 | 17.7 | 23.9 | NT* | NT | NT | NT |
| 4 | 162.5 | 124.9 | 18.2 | 17.4 | 403.7 | 49.6 | 25.5 | 14.5 |

*NT = No test performed.

As can be seen from Table 2, the samples that were pre-solution treated at 1550° F. for 8 hours (i.e., Sample Group 2) had better tensile strength, yield strength, elongation, and reduction in area, significantly better stress-rupture life and impact strength than the samples that were not pre-solution treated (i.e. Sample Group 1), as well as those that were pre-solution treated at 1600° F. and 1650° F. for 8 hours (i.e. Sample Groups 3 and 4). Further, the properties of the Sample Group 4 samples were slightly lower than for the samples that were not pre-solution treated, but were still considered to be acceptable.

As previously discussed, pre-solution treating wrought nickel-base alloys at a temperature ranging from 1550° F. to 1600° F. can result in the advantageous precipitation of the at least one grain boundary phase. Further, as previously discussed, the grain boundary phase, when present in the desired amount and form, is believed to strengthen the grain boundaries of the nickel-base alloy and thereby cause an improvement in the elevated temperature properties of the alloys.

Example 2

Test samples were prepared as discussed above in Example 1. The test samples were then divided into sample groups and the sample groups were subjected to the solution and aging treatments indicated below in Table 3.

TABLE 3

| Sample Group | Solution Treatment | First Aging Treatment | Second Aging Treatment |
|---|---|---|---|
| 5 | 1750° F. for 1 hour | 1325° F. for 8 hours | 1150° F. for 8 hours |
| 6 | 1750° F. for 1 hour | 1450° F. for 2 hours | 1200° F. for 8 hours |

TABLE 3-continued

| Sample Group | Solution Treatment | First Aging Treatment | Second Aging Treatment |
|---|---|---|---|
| 7 | 1800° F. for 1 hour | 1325° F. for 8 hours | 1150° F. for 8 hours |
| 8 | 1800° F. for 1 hour | 1450° F. for 2 hours | 1200° F. for 8 hours |

Between solution treating and the first aging treatment, the samples were air cooled, while a cooling rate of about 100° F. per hour (i.e., furnace cooling) was employed between the first and second aging treatments. After the second aging treatment, the samples were cooled to room temperature by air cooling.

After heat treating, the samples from each group were tested as described above in Example 1, except that instead of the room temperature Charpy tests conducted above in Example 1, the samples of Sample Groups 5-8 were subjected to additional tensile testing at room temperature ("$T_{rm}$"). The results of these tests are given below in Table 4, wherein the tabled values are average values for the samples tested.

TABLE 4

| Sample Group | UTS at $T_{rm}$ (ksi) | YS at $T_{rm}$ (ksi) | % EL at $T_{rm}$ | % RA at $T_{rm}$ | UTS at 1300° F. (ksi) | YS at 1300° F. (ksi) | % EL at 1300° F. | % RA at 1300° F. | Stress-Rupture Life at 1300° F. (Hours) | % EL at Rupture at 1300° F. |
|---|---|---|---|---|---|---|---|---|---|---|
| 5 | 205.9 | 158.9 | 25.5 | 38.2 | 164.1 | 135.1 | 16.3 | 17.8 | 386.2 | 36.4 |
| 6 | 218.8 | 174.7 | 21.9 | 35.7 | 170.3 | 145.7 | 19.3 | 18.1 | 433.1 | 35.4 |
| 7 | 205.1 | 155.6 | 27.4 | 44.8 | 147.6 | 114.7 | 14.4 | 21.0 | 330 | 49.0 |
| 8 | 205.3 | 149.9 | 27.8 | 44.0 | 160.7 | 125.2 | 12.4 | 14.1 | 1.9* | * |

*Notch Break Observed

As can be seen from the results in Table 4, the test samples of the Sample Groups 5, 6 and 8 had yield strengths of at least about 120 ksi at 1300° F., and percent elongations of at least about 12 percent at 1300° F. Further, Sample Groups 5-7 also had stress-rupture lives at 1300° F. and 80 ksi of at least about 300 hours and low notch sensitivity.

Between the two sample groups that were solution treated at 1750° F. (i.e., Sample Group 5 and Sample Group 6), the tensile and yield strength, both at room temperature and at 1300° F., the elevated temperature ductility, and the stress-rupture life of the Sample Group 6 test samples were generally improved as compared to the Sample Group 5 samples. Although not meant to be limiting herein, this is believed to be attributable to the higher aging temperatures used in aging the Sample Group 6 samples.

As further indicated in Table 4, notch breaks were observed in Sample Group 8. However, as indicated in Table 5, when stress-rupture testing was repeated on 4" round forged billet samples that were heat treated in a manner similar to the Sample Group 8 samples, notch breaks were not observed. Although the repeat testing was performed on 4" round forged billet samples as opposed to 8" round forged billet samples, the absence of notch breaking is not believed to be attributable to the different size of the sample. Accordingly, heat treatments such as the one used to heat treat Sample Group 8 are believed to be suitable in developing nickel-base alloys having desirable stress-rupture properties.

TABLE 5

| Solution Treatment* | First Aging Treatment** | Second Aging Treatment*** | Stress-Rupture Life at 1300° F. and 80 ksi | EL % at Rupture at 1300° F. |
|---|---|---|---|---|
| 1750° F. for 1 Hour | 1450° F. for 2 Hours | 1200° F. for 8 Hours | 558.4 | 27.6 |
| 1800° F. for 1 Hour | 1450° F. for 2 Hours | 1200° F. for 8 Hours | 525.5 | 32.2 |

*Between solution treating and the first aging treatment, the samples were air cooled.
**Between the first and second aging treatments, the samples were furnace cooled at a rate of about 100° F. per hour
***After the second aging treatment, the samples were cooled to room temperature by air cooling.

Example 3

Test samples were prepared as discussed above in Example 1. The test samples were then divided into sample groups and the sample groups were then solution treated at 1750° F. for the times indicated below for each sample group in Table 6. After solution treatment, each of the test samples was air cooled to room temperature, and subsequently aged at 1450° F. for 2 hours, furnace cooled to 1200° F., and aged for 8 hours before being air cooled to room temperature.

TABLE 6

| Sample Group | Solution Treatment Time |
|---|---|
| 9 | 1 Hour |
| 10 | 3 Hours |
| 11 | 4 Hours |

After heat treating, the samples from each sample group were tested as described above in Example 1, except that Charpy impact testing was not conducted on the test samples. The results of these tests are given below in Table 7, wherein the tabled values are average values for the samples tested.

TABLE 7

| Sample Group | Tensile Strength at 1300° F. (ksi) | Yield Strength at 1300° F. (ksi) | Percent Elongation at 1300° F. | Percent Reduction in Area at 1300° F. | Stress-Rupture Life at 1300° F. (Hours) | Percent Elongation at Rupture at 1300° F. |
|---|---|---|---|---|---|---|
| 9 | 170.3 | 145.7 | 19.3 | 18.1 | 433.1 | 35.4 |
| 10 | 162.5 | 132.6 | 27.8 | 33.8 | 190.4 | 32.8 |
| 11 | 162.6 | 136.7 | 25.8 | 30.6 | 185.1 | 47.5 |

As can be seen from the data in Table 7, while only Sample Group 9 had a stress-rupture life of at least 300 hours at 1300° F. and 80 ksi, all of the samples had yield strengths at 1300° F. of at least 120 ksi and percent elongations at 1300° F. of at least 12 percent. Although the stress-rupture properties of Sample Groups 10 and 11 are lower than those of Sample Group 9, it is believed that solution treatment times greater than 2 hours may, nevertheless, be useful in certain applications. Further, as previously discussed, when larger sized samples or work-pieces are heat treated, solution times greater than 2 hours may be required in order to dissolve substantially all of the γ' and γ"-phase precipitates.

Example 4

Test samples were prepared from a 4" diameter, round-cornered, square reforged billet having a grain size ranging from ASTM 4.5 to ASTM 5.5, with an average grain size of ASTM 5, as determined according to ASTM E 112. The test samples were then divided into sample groups and the sample groups were solution treated at 1750° F. for 1 hour and cooled to room temperature at the cooling rates indicated below for each sample group in Table 8. After cooling to room temperature, the samples were aged at 1450° F. for 2 hours, furnace cooled to 1200° F., and aged for 8 hours before being air cooling to room temperature.

TABLE 8

| Sample Group | Cooling Rate After Solution Treatment |
|---|---|
| 12 | about 22,500° F./Hour (Air Cool) |
| 13 | 1000° F./Hour |
| 14 | 400° F./Hour |

After heat treating, the samples from each sample group were tested as described above in Example 3. The results of these tests are given below in Table 9, wherein the tabled values are average values for the samples tested.

TABLE 9

| Sample Group | Tensile Strength at 1300° F. (ksi) | Yield Strength at 1300° F. (ksi) | Percent Elongation at 1300° F. | Percent Reduction in Area at 1300° F. | Stress-Rupture Life at 1300° F. (Hours) | Percent Elongation at Rupture at 1300° F. |
|---|---|---|---|---|---|---|
| 12 | 154.7 | 127.2 | 22.6 | 28.1 | 315.5 | 35.4 |
| 13 | 155.0 | 122.9 | 34.0 | 54.9 | 591.4 | 40.3 |
| 14 | 144.8 | 110.0 | 38.3 | 75.5 | 363.5 | 26.3 |

As can be seen from the data in Table 9, when the cooling rate after solution treatment was low (e.g., 400° F. per hour for Sample Group 14), yield strengths less than 120 ksi at 1300° F. were achieved. At higher cooling rates (e.g., 1000° F. per hour for Sample Group 13 and 22,500° F. per hour for sample group 14), yield strengths of at least 120 ksi at 1300° F. were observed. However, percent elongations at 1300° F. of at least 12 percent and stress-rupture lives of at least 300 hours at 1300° F. and 80 ksi were observed for all samples.

Example 5

Test samples were prepared as discussed above in Example 1. Thereafter, the test samples were divided into Sample Groups 15-21. The samples were solution treated at 1750° F. for 1 hour. After solution treatment, the samples were cooled to room temperature at a rate of about 22,500° F. per hour (air cool) prior to aging as indicated in Table 10.

After the first aging treatment, all of the samples were furnace cooled to the second aging temperature, resulting in an average cooling rate of about 50° F. to about 100° F. per hour. Further, after the second aging treatment was completed, the samples were air cooled to room temperature.

TABLE 10

| | First Aging Treatment | | Second Aging Treatment | |
|---|---|---|---|---|
| Sample Group # | Aging Temperature (° F.) | Aging Time (Hours) | Aging Temperature (° F.) | Aging Time (Hours) |
| 15 | 1365 | 8 | 1150 | 8 |
| 16 | 1365 | 8 | 1200 | 8 |
| 17 | 1400 | 8 | 1150 | 8 |
| 18 | 1400 | 8 | 1200 | 8 |
| 19 | 1450 | 8 | 1200 | 8 |
| 20 | 1450 | 2 | 1150 | 8 |
| 21 | 1450 | 2 | 1200 | 8 |

After heat treating, at least 2 samples from each sample group were tested as described above in Example 3. The results of these tests are given below in Table 11, wherein the tabled values are average values for the samples tested.

TABLE 11

| Sample Group | Tensile Strength at 1300° F. (ksi) | Yield Strength at 1300° F. (ksi) | Percent Elongation at 1300° F. | Percent Reduction in Area at 1300° F. | Stress-Rupture Life at 1300° F. (Hours) | Percent Elongation at Rupture at 1300° F. |
|---|---|---|---|---|---|---|
| 15 | 165.4 | 138.8 | 19.1 | 20.6 | 342.5 | 30.6 |
| 16 | 165.6 | 135.5 | 18.9 | 24.5 | 349.0 | 37.5 |
| 17 | 169.5 | 141.0 | 16.3 | 21.8 | 311.5 | 36.5 |
| 18 | 162.2 | 123.6 | 16.6 | 19.8 | 313.7 | 47.0 |
| 19 | 165.2 | 141.2 | 30.5 | 48.7 | 312.5 | 34.5 |
| 20 | 165.7 | 135.2 | 16.9 | 18.6 | 361.3 | 32.7 |
| 21 | 170.3 | 145.7 | 19.3 | 18.1 | 433.1 | 35.4 |

The thermal stability of the mechanical properties at elevated temperatures of the test samples was also tested by exposing at least 2 samples from each sample group to 1400° F. for 100 hours prior to testing as indicated above. The results of these tests are given in Table 12 below.

TABLE 12

| Sample Group | *Tensile Strength at 1300° F. (ksi) | *Yield Strength at 1300° F. (ksi) | *Percent Elongation at 1300° F. | *Percent Reduction in Area at 1300° F. | *Stress-Rupture Life at 1300° F. (Hours) | *Percent Elongation at Rupture at 1300° F. |
|---|---|---|---|---|---|---|
| 15 | 161.4 | 134.3 | 28.1 | 32.3 | 452.5 | 21.9 |
| 16 | 163.3 | 131.2 | 18.8 | 17.5 | 382.1 | 40.8 |
| 17 | 154.3 | 127.9 | 38.0 | 70.0 | 367.0 | 34.6 |
| 18 | 153.3 | 125.3 | 34.9 | 46.2 | 418.1 | 33.7 |
| 19 | 157.5 | 131.0 | 40.2 | 60.2 | 276.8 | 33.0 |
| 20 | 150.9 | 132.6 | 35.5 | 50.9 | 507.2 | 31.8 |
| 21 | 161.7 | 138.1 | 33.2 | 49.1 | 517.1 | 42.8 |

*Exposed at 1400° F. for 100 hours prior to testing.

As can be seen from the data of Tables 11 and 12, samples aged at a first aging temperature of about 1450° F. for 2 hours and a second aging temperature of about 1200° F. for 8 hours (i.e., Sample Group 21) had the highest combination of 1300° F. ultimate tensile and yield strengths and the highest stress-rupture life. After thermal exposure at 1400° F. (Table 12), the samples of Sample Group 21 had the highest 1300° F. yield strength and stress-rupture life. These results were followed closely by samples from Groups 15, 16, and 20.

Further, it can be seen that the ductility of the alloys was improved after long-term thermal exposure. Although not meant to be bound by any particular theory, it is believed that because the samples were not pre-solution treated and the cooling rate employed in cooling the samples from the solution temperature was high (about 22,500° F./hour), formation of desirable grain boundary δ/η-phase precipitates, as previously discussed in detail, was not achieved until after thermal exposure.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, the present invention is not limited to the particular embodiments disclosed, but is intended to cover modifications that are within the spirit and scope of the invention, as defined by the appended claims.

We claim:

1. A nickel-base alloy comprising:

a matrix comprising γ'-phase precipitates and γ"-phase precipitates, wherein the γ'-phase precipitates are predominant strengthening precipitates in the nickel-base alloy; and an amount of grain boundary precipitates sufficient to pin the majority of the grain boundaries in the matrix, the grain boundary precipitates being selected from the group consisting of δ-phase precipitates, η-phase precipitates, and mixtures thereof, and having short, generally rod-shaped morphologies; and wherein the nickel-base alloy comprises, in percent by weight, up to 0.1% carbon, from 12% to 20% chromium, up to 4% molybdenum, up to 6% tungsten, from 5% to 12% cobalt, up to 14% iron, from 4% to 8% niobium, from 0.6% to 2.6% aluminum, from 0.4 % to 1.4 % titanium, from 0.003 % to 0.03 % phosphorus, from 0.003% to 0.015% boron, and nickel;

wherein a sum of the weight percent molybdenum and the weight percent tungsten is at least 2% and not more than 8%;

and wherein a sum of atomic percent aluminum and atomic percent titanium is from 2% to 6%, a ratio of atomic percent aluminum to atomic percent titanium is at least 1.5, and the sum of atomic percent aluminum and atomic percent titanium, that sum divided by atomic percent niobium is from 0.8 to 1.3.

2. The nickel-base alloy of claim 1 wherein the nickel-base alloy has a notched stress-rupture life of at least 400 hours as measured at 1300° F. and 80 ksi, and a low notch-sensitivity.

3. A heat treated nickel-base alloy including up to 14 weight percent iron and comprising a matrix comprising γ'-phase precipitates and γ"-phase precipitates, wherein the γ'-phase precipitates are predominant strengthening precipitates in the nickel-base alloy, and an amount of grain boundary precipitates sufficient to pin the majority of the grain boundaries in the matrix, the grain boundary precipitates being selected from the group consisting of δ-phase precipitates, η-phase precipitates, and mixtures thereof, and having short, generally rod-shaped morphologies, and wherein the nickel-base alloy is heat treated by:

pre-solution treating the nickel-base alloy at a temperature ranging from 1500° F. to 1650° F. for a time ranging from 2 to 16 hours;

solution treating the nickel-base alloy for no greater than 4 hours at a solution temperature ranging from 1725° F. to 1850° F., cooling the nickel-base alloy at a first cooling rate of at least 800° F. per hour after solution treating the nickel-base alloy;

aging the nickel-base alloy in a first aging treatment from 2 hours to 8 hours at a temperature ranging from 1325° F. to 1450° F.; and aging the nickel-base alloy in a second aging treatment for at least 8 hours at a second aging temperature, the second aging temperature ranging from 1150° F. to 1300° F.

4. The nickel-base alloy of claim 3 wherein the nickel-base alloy has a notched stress-rupture life of at least 400 hours as measured at 1300° F. and 80 ksi, and a low notch-sensitivity.

5. An article of manufacture comprising a nickel-base alloy, the nickel-base alloy comprising:

a matrix comprising γ'-phase precipitates and γ"-phase precipitates, wherein the γ'-phase precipitates are predominant strengthening precipitates in the nickel-base alloy; and an amount of grain boundary precipitates sufficient to pin the majority of the grain boundaries in the matrix, the grain boundary precipitates being selected from the group consisting of δ-phase precipitates, η-phase precipitates, and mixtures thereof, wherein the at least one grain boundary precipitates has a short, generally rod-shaped morphologies; and wherein the nickel-base alloy comprises, in percent by weight, up to 0.1% carbon, from 12% to 20% chromium, up to 4% molybdenum, up to 6% tungsten, from 5% to 12% cobalt, up to 14% iron, from 4% to 8% niobium, from 0.6% to 2.6% aluminum, from 0.4% to 1.4% titanium, from 0.003% to 0.03% phosphorus, from 0.003% to 0.015% boron, and nickel;

wherein a sum of the weight percent molybdenum and the weight percent tungsten is at least 2% and not more than 8%;

and wherein a sum of atomic percent aluminum and atomic percent titanium is from 2% to 6%, a ratio of atomic percent aluminum to atomic percent titanium is at least 1.5, and the sum of atomic percent aluminum and atomic percent titanium, that sum divided by atomic percent niobium is from 0.8 to 1.3.

6. The article of manufacture of claim 5 wherein the article of manufacture is selected from the group consisting of a turbine or compressor disk, a blade, a case, a shaft, and a fastener.

7. The nickel-base alloy of claim 5 wherein the nickel-base alloy has a notched stress-rupture life of at least 400 hours as measured at 1300° F. and 80 ksi, and a low notch-sensitivity.

* * * * *